US010008138B2

(12) United States Patent
Bonifas

(10) Patent No.: US 10,008,138 B2
(45) Date of Patent: Jun. 26, 2018

(54) SELF-ERECTABLE DISPLAYS AND METHODS OF MAKING SUCH SELF-ERECTABLE DISPLAYS

(71) Applicant: R.R. Donnelley & Sons Company, Chicago, IL (US)

(72) Inventor: Travis P. Bonifas, Aurora, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days. days.

(21) Appl. No.: 14/988,616

(22) Filed: Jan. 5, 2016

(65) Prior Publication Data

US 2017/0193866 A1 Jul. 6, 2017

Related U.S. Application Data

(60) Provisional application No. 62/273,597, filed on Dec. 31, 2015.

(51) Int. Cl.
*G09F 15/00* (2006.01)
*G09F 1/06* (2006.01)

(52) U.S. Cl.
CPC ..... *G09F 15/0062* (2013.01); *G09F 1/065* (2013.01)

(58) Field of Classification Search
CPC ..... G09F 15/0062; G09F 1/065
See application file for complete search history.

(56) References Cited

U.S. PATENT DOCUMENTS 822,841 A 6/1906 Hill
956,916 A 5/1910 Wiederseim, Jr.
1,028,147 A 6/1912 Stranders
1,545,771 A 7/1925 Hout
1,576,672 A 3/1926 Miller
1,656,341 A 1/1928 Smith
(Continued)

FOREIGN PATENT DOCUMENTS

CN 203192354 9/2013
DE 2658506 1/1978
(Continued)

OTHER PUBLICATIONS

United States Patent and Trademark Office, "Non-Final Office Action," issued in connection with U.S. Appl. No. 14/709,266, dated May 23, 2016, 32 pages.
(Continued)

*Primary Examiner* — Gary C Hoge
(74) *Attorney, Agent, or Firm* — Hanley, Flight and Zimmerman LLC

(57) ABSTRACT

Self-erectable displays and methods of making such self-erectable displays are disclosed. An example apparatus includes a shroud including a first shroud panel, a second shroud panel coupled to the first shroud panel, and an interior formed between the first shroud panel and the second shroud panel; a support disposed in the interior of the shroud, the support including a first tongue and a second tongue, the first tongue to extend through a first aperture of the support, the second tongue to extend through a second aperture of the support, the first and second tongues to extend in opposing directions; and a biasing member coupled to the support to cause a portion of the first shroud panel to separate from a portion of the second shroud panel.

20 Claims, 10 Drawing Sheets

(56) References Cited

U.S. PATENT DOCUMENTS 1,670,464 A 5/1928 Marsh
1,687,616 A 10/1928 Huye
1,902,566 A 3/1933 Marsh
2,108,349 A 2/1938 Rasmussen
2,113,288 A 4/1938 Berger
2,142,826 A 1/1939 Rosello
2,153,460 A 4/1939 Giles
2,210,317 A 8/1940 Dueringer
2,283,406 A 5/1942 Bacon
2,290,144 A 7/1942 Katz
2,404,089 A 7/1946 Pollock
2,601,374 A 6/1952 Ditzler et al.
2,637,924 A 5/1953 Hutt
2,728,461 A 12/1955 Paige
2,773,324 A 12/1956 Drueck, Jr.
2,833,074 A 5/1958 Jannes
2,892,276 A 6/1959 Nelson
2,918,178 A 12/1959 Leone
2,984,920 A 5/1961 Acosta et al.
3,015,898 A 1/1962 Keeslar
3,091,877 A 6/1963 Luchsinger
3,234,682 A 2/1966 Frankl
3,267,597 A 8/1966 Jannes
3,302,321 A 2/1967 Walker
3,571,958 A 3/1971 Stevens et al.
3,665,669 A 5/1972 Huber
3,666,607 A 5/1972 Weissman
4,234,148 A 11/1980 Maddestra et al.
4,610,363 A 9/1986 Flum et al.
4,619,426 A 10/1986 Drueck, Jr.
4,750,283 A 6/1988 Halpern
4,770,379 A 9/1988 Estvold
4,773,622 A 9/1988 Herlin
4,774,780 A 10/1988 Crowell
4,790,714 A 12/1988 Schnapp
4,854,060 A 8/1989 Corbo et al.
4,940,199 A 7/1990 Hall
4,984,848 A 1/1991 Scalisi et al.
4,993,846 A 2/1991 Diamond et al.
5,000,717 A 3/1991 Pfeiffer
5,193,466 A 3/1993 Eder
5,197,631 A 3/1993 Mishima
5,297,677 A 3/1994 Burian et al.
5,416,997 A 5/1995 Dyment et al.
5,454,180 A 10/1995 Volpe
5,467,547 A 11/1995 Fortner
5,632,390 A 5/1997 Podergois
5,752,649 A 5/1998 Weder
5,758,438 A 6/1998 Crowell
5,778,959 A 7/1998 Guetschow
5,787,621 A 8/1998 Leksell
5,809,673 A 9/1998 Johnson et al.
5,868,367 A 2/1999 Smith
5,878,945 A 3/1999 Weder
5,937,553 A 8/1999 Maran
5,966,857 A 10/1999 Pettersson et al.
5,983,538 A 11/1999 Crowell
6,311,418 B1 11/2001 Crowell
6,347,772 B1 2/2002 L'Hotel
6,497,601 B1 12/2002 Ward
7,134,230 B1 11/2006 Boens et al.
7,159,350 B2 1/2007 L'Hotel
7,234,253 B2 6/2007 Ossmann
7,437,842 B2 * 10/2008 Sgambellone ..... G09F 1/06 248/174
7,634,865 B2 12/2009 L'Hotel
7,726,054 B2 6/2010 Mestres Armengol et al.
7,774,964 B2 8/2010 L'Hôtel
7,980,013 B2 7/2011 Hsu
8,099,883 B2 1/2012 Mestres Armengol et al.
8,112,925 B2 2/2012 Tzuo
8,291,631 B2 10/2012 Wilder
8,458,939 B2 6/2013 Arthur et al.
8,590,188 B2 11/2013 Mirsch
8,701,321 B2 4/2014 Da Fonseca et al.
8,776,415 B2 7/2014 Kawaguchi et al.
8,826,833 B1 * 9/2014 Fischer ..... A47B 43/02 108/162
8,863,418 B2 10/2014 Acker et al.
8,875,908 B2 11/2014 L'Hotel
9,173,485 B2 11/2015 Fischer et al.
2004/0111930 A1 6/2004 Ossmann
2008/0066353 A1 3/2008 Mills
2008/0083146 A1 * 4/2008 Martin Presa ..... G09F 1/06 40/600
2010/0072330 A1 * 3/2010 Tzuo ..... A47B 43/02 248/174
2010/0236117 A1 * 9/2010 Mestres Armengol ... A47F 5/10 40/610
2011/0088300 A1 * 4/2011 Martin Presa ..... G09F 1/06 40/606.12
2011/0179685 A1 7/2011 Mirsch
2012/0012734 A1 1/2012 Tzuo
2012/0227297 A1 * 9/2012 Kawaguchi ..... G09F 1/06 40/610
2013/0219760 A1 * 8/2013 Acker ..... G09F 1/06 40/610
2014/0265777 A1 9/2014 Fischer et al.
2016/0335925 A1 11/2016 Ruhaak
2016/0335934 A1 11/2016 Lyon
2016/0335935 A1 11/2016 Lyon
2017/0213485 A1 7/2017 Santoro, Jr.
2017/0294149 A1 10/2017 Lyon
2018/0040262 A1 2/2018 Lyon
2018/0075781 A1 3/2018 Cwidak et al.
2018/0075788 A1 3/2018 Warmus et al.

FOREIGN PATENT DOCUMENTS

DE 4005925 10/1991
DE 4314654 11/1994
DE 9320993 8/1995
DE 202010015312 1/2011
DE 202011002980 4/2011
DE 202014106297 3/2015
DK 9500055 5/1995
DK 9500277 9/1995
EP 1926076 9/1995
EP 1741368 1/2007
EP 1830334 9/2007
EP 2290637 3/2011
EP 2400477 12/2011
ES 2212927 8/2004
ES 2255857 7/2006
FR 1254983 3/1961
FR 2210317 7/1974
FR 2232259 12/1974
FR 2233912 1/1975
FR 2571949 4/1986
FR 2574968 6/1986
FR 2650907 2/1991
FR 2680030 2/1993
FR 2691621 12/1993
FR 2730148 8/1996
FR 2735264 12/1996
FR 2745109 8/1997
FR 2760801 9/1998
FR 2760802 9/1998
FR 2760880 9/1998
FR 2770320 4/1999
FR 2911425 7/2008
FR 2925203 6/2009
FR 2925204 6/2009
FR 2948222 1/2011
GB 463574 4/1937
GB 740577 11/1955
GB 743378 1/1956
GB 824004 11/1959
GB 1034280 6/1966
GB 1272187 1/1972
GB 1317155 5/1973
WO 9634379 10/1996
WO 9936900 7/1999

(56) References Cited

FOREIGN PATENT DOCUMENTS

| | | |
|---|---|---|
| WO | 02095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2010019086 | 2/2010 |
| WO | 2010130485 | 11/2010 |
| WO | 2011092209 | 8/2011 |
| WO | 2011113123 | 9/2011 |
| WO | 2012061375 | 5/2012 |
| WO | 2016057067 | 4/2016 |

OTHER PUBLICATIONS

United States Patent and Trademark Office, "Office Action," issued in connection with U.S. Appl. No. 14/709,285, dated Mar. 15, 2017, 24 pages.

United States Patent and Trademark Office, "Notice of Allowance," issued in connection with U.S. Appl. No. 15/229,920, dated Mar. 22, 2017, 43 pages.

United States Patent and Trademark Office, "Non-Final Office Action," issued in connection with U.S. Appl. No. 15/229,920, dated Dec. 1, 2016, 9 pages.

International Searching Authority, "International Search Report and Written Opinion," issued in connection with International Patent Application No. PCT/US2016/064478, dated Jan. 24, 2017, 15 pages.

United States Patent and Trademark Office, "Final Office Action," issued in connection with U.S. Appl. No. 14/711,739, dated Mar. 21, 2017, 19 pages.

United States Patent and Trademark Office, "Office Action," issued in connection with U.S. Appl. No. 15/415,587, dated Aug. 4, 2017, 40 pages.

United States Patent and Trademark Office, "Notice of Allowance," issued in connection with U.S. Appl. No. 14/709,266, dated Apr. 12, 2017, 17 pages.

United States Patent and Trademark Office, "Notice of Allowance," issued in connection with U.S. Appl. No. 14/709,285, dated Jul. 3, 2017, 19 pages.

International Searching Authority, "International Search Report," issued in connection with PCT Patent Application No. PCT/US2017/045471, dated Oct. 18, 2017, 5 pages.

International Searching Authority, "Written Opinion," issued in connection with PCT Patent Application No. PCT/US2017/045471, dated Oct. 18, 2017, 6 pages.

United States Patent and Trademark Office, "Office Action," issued in connection with U.S. Appl. No. 15/261,178, dated Sep. 29, 2017, 46 pages.

United States Patent and Trademark Office, "Notice of Allowance," issued in connection with U.S. Appl. No. 15/415,587, dated Jan. 19, 2018, 7 pages.

United States Patent and Trademark Office, "Non-Final Office action," issued in connection with U.S. Appl. No. 15/634,974, dated Apr. 9, 2018, 11 pages.

* cited by examiner

SELF-ERECTABLE DISPLAYS AND METHODS OF MAKING SUCH SELF-ERECTABLE DISPLAYS

RELATED APPLICATION

This patent claims priority to U.S. Provisional Patent Application Ser. No. 62/273,597 filed Dec. 31, 2015. U.S. Provisional Patent Application Ser. No. 62/273,597 is hereby incorporated herein by reference in its entirety.

FIELD OF THE DISCLOSURE

This disclosure relates generally to displays and, more particularly, to self-erectable displays and methods of making such self-erectable displays.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
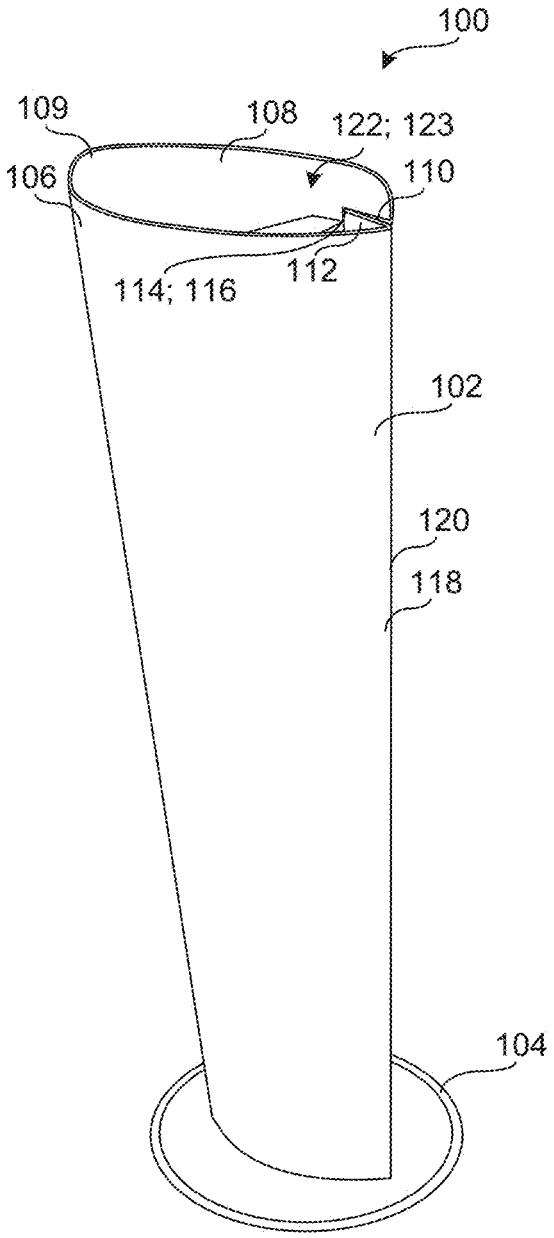
FIG. 1 is a perspective view of an example self-erectable display in accordance with the teachings of this disclosure.

The examples disclosed herein relate to self-erectable displays that can be used for point-of-sale advertising, providing information or for other suitable purposes. In some examples, the example self-erectable displays may be shipped to a customer in a folded, flat state. The example displays may include a biased support that is in a state of tension when the display is in the folded, flat state because forces imparted on the folded material of the display are greater than a force exerted by the biased support. However, when the display is unfolded, the force being imparted on the biased support is less than the force exerted by the biased support, thereby enabling the biased support to urge the display from the folded position to the erected position. Thus, using the examples disclosed herein, an individual can erect the example displays with little if any instruction and/or training.

In some examples disclosed herein, the example self-erectable displays include an elongate, tubular shroud into which an internal structure is disposed. In some examples, the shroud includes an oblong cross-section having an example base coupled at an end and the internal structure includes an example biased support(s) coupled within the shroud. In some examples, the cross-section may be another shape including, for example, triangular, square, diamond, circular, or other semi-circular, elliptical, polygonal and/or non-polygonal shape(s).

In some examples, the example shroud is formed of an elongate substrate having top and bottom edges and first and second side edges. To enable the example self-erectable display to be folded for shipping and/or storage, in some examples, longitudinal lines of weakness and transverse lines of weakness are defined by the shroud. The longitudinal lines of weakness may enable the example self-erectable display to be folded relatively flat and the transverse lines of weakness may enable the example self-erectable display to be folded about itself to form a z-fold, for example.

In some examples, the longitudinal and transverse lines of weakness define central panels and outwardly facing flaps. To form the tubular-shaped shroud, the shroud is folded about a central line of weakness and the flaps are inwardly folded and coupled to enable the shroud to have an oblong cross-section and/or to define an aperture or interior space. However, in other examples, the shroud is formed from separate panels that are coupled, for example. In some examples, to enable the shroud to be more easily folded about itself, notches are defined between the flaps.

In some examples, the example support is formed of two substrates and/or support portions that are folded and/or coupled to form the example support. In some examples, the support portions include top and bottom edges and first and second side edges. To enable the support including the two example support portions to be folded relatively flat within the example shroud for shipping and/or storage, in some examples, lines of weakness are formed in the respective support portions. In some examples, the lines of weakness of each of the support portions define two relatively larger panels, two relatively smaller panels and one panel including a tongue(s). In some examples, the panel with the tongue is disposed on an end of the support portion that opposes one of the smaller panels defining and/or at least partially defining an aperture through which the tongue is to be disposed. In some examples, the larger panels are disposed on either side of a smaller centrally positioned panel. In some examples, the aperture through which the tongue is to be disposed is defined by one of the larger panels and one of the smaller panels. To enable an elastic band to be more easily coupled to the support, in some examples, notches and/or keyed apertures are formed between the larger panels and the smaller panels that receive the elastic band(s). In some examples, the elastic band may be another suitable biasing member.

To form the tubular-shaped support portion, in some examples, the support portion is folded about the lines of weakness and the tongue on the end of the support portion is inserted through the aperture. In some examples, the tongue is sized to protrude through the aperture when the support and/or the support portion is in a flat and/or folded state. After the tongues of two of the support portions are protruding through the respective apertures, the support portions are positioned to oppose one another to enable the tongues to extend in opposing direction and to enable two or more of the smaller panels of the respective ones of the support portions to be coupled together to form a single support. In some examples, the smaller panels are coupled using an adhesive and/or double sided tape. In other examples any suitable mechanical or chemical fastener, or combination of fasteners, may be used.

To inwardly urge the smaller panels toward one another and to outwardly extend the tongues, in some examples, a first elastic band is disposed about the notches at a first end of the support and a second elastic band is disposed about notches at a second end of the support. However, in some examples, the support is biased using a single elastic band disposed on one end of the support. In some examples, the elastic band urges a first stop of the first support portion to engage a second stop of the second support portion to position the support in a relatively stable erected state.

To form the self-erectable display, the example tubular support is coupled within the example tubular shroud. In some examples, smaller support panels of the first and second support portions are directly coupled to the shroud panels such that the opposing tongues face the flaps of the shroud, ends of the shroud, opposing flaps of the shroud and/or the central lines of weakness of the shroud. When the support is coupled within the tubular-shaped shroud, the shroud panels are outwardly biased by the smaller support panels and/or the ends of the shroud are outwardly biased by the opposing tongues. However, in some examples, if the smaller support panels are moved toward one another against the biasing force of the elastic band, the tongues are withdrawn from and/or moved relative to the respective apertures to enable the shroud panels to move toward one another and be disposed immediately adjacent one another. When the shroud panels are disposed adjacent one another, the shroud may be folded about itself along the transverse lines of weakness to enable the display to be stored and/or shipped. Thus, the examples disclosed herein enable a display to be folded flat for storage and to later self-erect into a tubular shape.

FIG. 1 illustrates an example self-erectable display 100 including a tubular-shaped shroud 102 coupled to a base 104. In other examples, the example self-erectable display 100 may not include the base 104 such that the shroud 102 is used as an upright display without the base 104.

In this example, the shroud 102 includes opposing first and second shroud panels 106, 108 that are separated by a central line of weakness 109 and flaps 110, 112 adjacent side edges 114, 116 of the shroud 102. In this example, the flaps 110, 112 are coupled together to enclose the shroud 102 and to enable adjacent longitudinal lines of weakness 118, 120 to define an outward facing end of the tubular-shaped shroud 102 opposite the central line of weakness 109 that defines another outward facing end of the shroud 102. To enable the display 100 to be self-erecting, example first and second biased supports 122, 123 are disposed within the example shroud 102.

Figure 2:
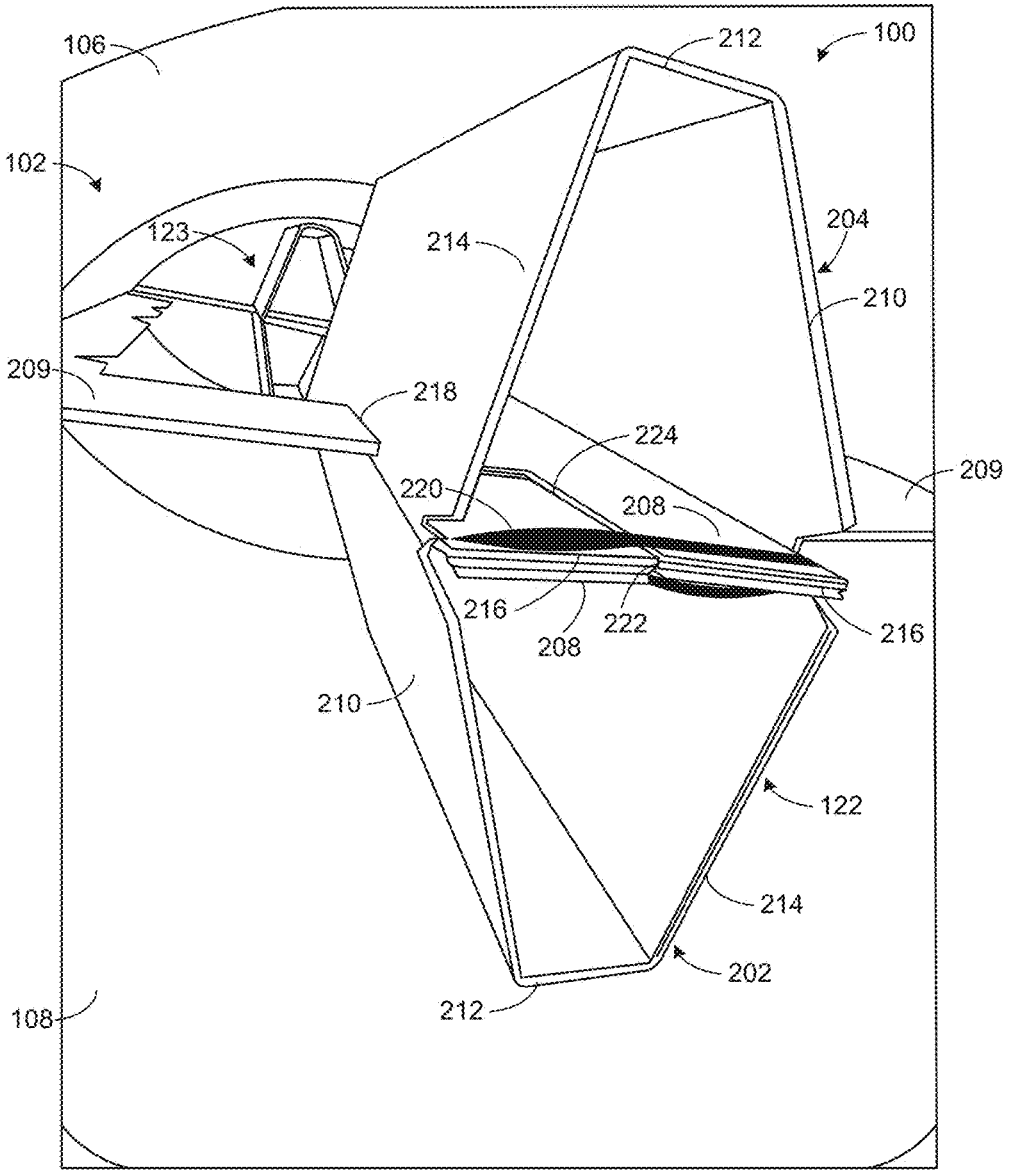
FIG. 2 is a top view of the self-erectable display of FIG. 1.

FIG. 2 shows a top view of the example self-erectable display 100 that illustrates the biased supports 122, 123 coupled within and/or disposed within the shroud 102. In this example, the supports 122, 123 are the same or substantially the same size and/or shape. Referring to the first biased support 122, in this example, the first biased support 122 includes a first support portion 202 and a second support portion 204 where the second support portion 204 is substantially the same as or is the same as the first support portion 202. As set forth herein, the phrase substantially the same accounts for manufacturing tolerances.

In the illustrated example, the first and second support portions 202, 204 includes a first support panel 208 including a tongue 209, a second support panel 210, a third support panel 212, a fourth support panel 214 and a fifth support panel 216 defining an aperture 218. In some examples, the aperture 218 is defined by one or more of the fourth support panel 214 and/or the fifth support panel 216. As shown in the example of FIG. 2, to form the example biased support 122 including the first and second support portions 202, 204, the first support panel 208 of the first support portion 202 is coupled to the fifth support panel 216 of the second support portion 204 and/or the first support panel 208 of the second support portion 204 is coupled to the fifth support panel 216 of the first support portion 202.

Figure 3:
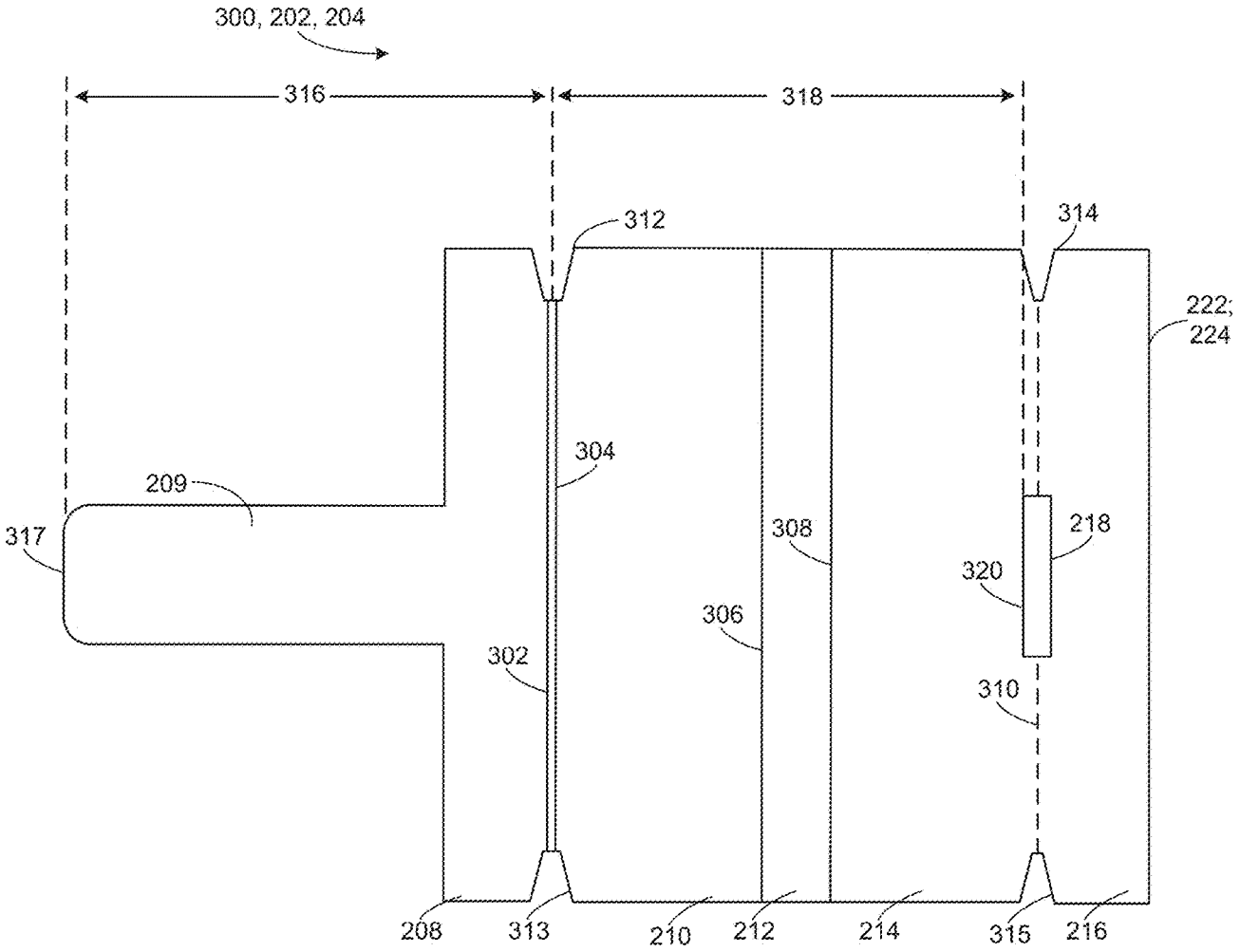
FIG. 3 illustrates a plan view of an example support portion in a flat state that can be used to implement the example self-erectable display of FIG. 1.

In the illustrated example of FIG. 3, a substrate and/or support portion 300 is shown that can be used to form the first and/or second support portions 202, 204. In this example, the support portion 300 includes a multiple lines of weakness including a first line of weakness 302, a second line of weakness 304, a third line of weakness 306, a fourth line of weakness 308 and a fifth line of weakness 310. The lines of weakness 302, 304, 306, 308, 310 may be similar or different. While other examples exist, one or more of the lines of weakness 302, 304, 306, 308, 310 may be perforations and one or more of the lines of weakness 302, 304, 306, 308, 310 may be creases or folds or any other line of weakness (e.g., score lines, etc.).

As shown in the illustrated example of FIG. 3, the lines of weakness 302, 304, 306, 308, 310 collectively define the first support panel 208 including the tongue 209, the second support panel 210, the third support panel 212, the fourth support panel 214 and the fifth support panel 216. In this example, the second and fourth panels 210, 214 are relatively larger than the third and fifth support panels 212, 216 in terms of width. However, other dimensions may be used in other examples.

To enable an elastic band 220 (FIG. 2) to be disposed about the support 122 and/or the support portions 300, 202, 204, notches 312, 313 are defined between the first support panel 208 and the second support panel 210 and notches 314, 315 are defined the fourth support panel 214 and the fifth support panel 216. In this example, the notches 312, 313 are v-shaped and oppose one another and the notches 314, 315 are v-shaped and oppose one another. In other examples, one or more of the notches 312, 313, 314, 315 may be differently shaped and/or the support portion 300 and/or the first and/or second support portions 202, 204 may define more or less notches than shown in this example. For example, the notches may be key shaped and/or any other shape that may enable an elastic band to be retained in place.

When the support portion 300 is folded about the lines of weakness 302, 304, 306, 308 and/or 310, in this example, the tongue 209 is positioned through the aperture 218. In the illustrated example of FIG. 3, to enable the tongue 209 to extend through the aperture 218 when the support portions 300, 202, 204 and/or the support 122, 123 is in the folded position, a first distance 316 between an end 317 of the tongue 209 and the first and/or second lines of weakness 302, 304 is greater than a second distance 318 between the first and/or second lines of weakness 302, 304 and an edge 320 defining the aperture 218. In other words, in some examples, the relative distances 316, 318 enable the tongue 209 to penetrate the aperture 218 in both the erected position and the flattened position so no adhesive or other fastener is needed to retain the tongue 209 within the aperture 218. This prevents the tongue 209 from being inadvertently removed from the aperture 218 when the display 100 is flattened. Maintaining the tongue 209 within the aperture 218 enables the support portions 202, 204 to retain a tubular shape without glue and/or other fasteners being needed, saving an extra assembly step.

Referring to FIG. 2, after the tongues 209 of the respective ones of the first and second support portions 300, 202, 204 are positioned through the corresponding apertures 218, the first and second support portions 300, 202, 204 are arranged to enable the tongues 209 to extend in opposing directions and for the first support panel 208 of the first support portion 202 to be coupled to the fifth support panel 216 of the second support portion 204 and for the first support panel 208 of the second support portion 204 to be coupled to the fifth support panel 216 of the first support portion 202. After the first and second support portions 300, 202, 204 are coupled, biasing members such as, for example, the elastic band 220 may be positioned about the support 122 and held in place, in this example, by being disposed within the notches 312, 314 and/or notches 313, 315. The interaction between the elastic band 220 and the substrate 228 urges the tongues 209 through the respective apertures 218 and urges stops and/or ends 222, 224 of the fifth support panel 216 to engage and position the support 122 in a stable state. In some examples, the stops 222, 224 engage along a central portion and/or a central axis of the support 122. In other words, the engagement between the stops 222, 224 is spaced from the support panels 210, 212, 214 and/or from the aperture 218.

After the support 122 is formed into a tubular shape and the elastic band(s) 220 is disposed about the support portions 300, 202, 204, the third support panel 212 of the first and second support portions 300, 202, 204 is positioned adjacent and/or coupled to the first and second shroud panels 106, 108. In some examples, the opposing third support panels 212 may be coupled to the first shroud panel 106 and the second shroud panel 108, respectively, in any suitable way such as, for example, with adhesive, glue, tape, staples, and/or any other suitable mechanical and/or chemical fastener(s). In some examples, the third support panels 212 and/or the supports 122, 123 are positioned and/or coupled within the display 100 without the use of adhesive and/or other fastener(s). In such examples, an interference fit may be formed between the supports 122, 123 and the display 100 that enables the supports 122, 123 to self-align within the display 100.

As shown in the example of FIG. 2, the elastic band 220 brings the stops 222, 224 together and/or into stopping engagement to position the supports 122, 123 in a relatively stable state. In some examples, the elastic band 220 brings the stops 222, 224 together to extend the opposing tongues 209 toward the ends 109, 118 and/or 120 of the display 100. In some examples, bringing the stops 222, 224 together extends the opposing third panels 212 to outwardly urge the first shroud panel 106 and the second shroud panel 108 to have an oblong cross-section when erected. To flatten the example self-erectable display 100, the opposing third support panels 212, the first shroud panel 106 and the second shroud panel 108 are urged toward one another against the biasing force of the elastic band 220. For example, a user may push the first shroud panel 106 and the second shroud panel 108 together to flatten the display 100.

Figure 4:
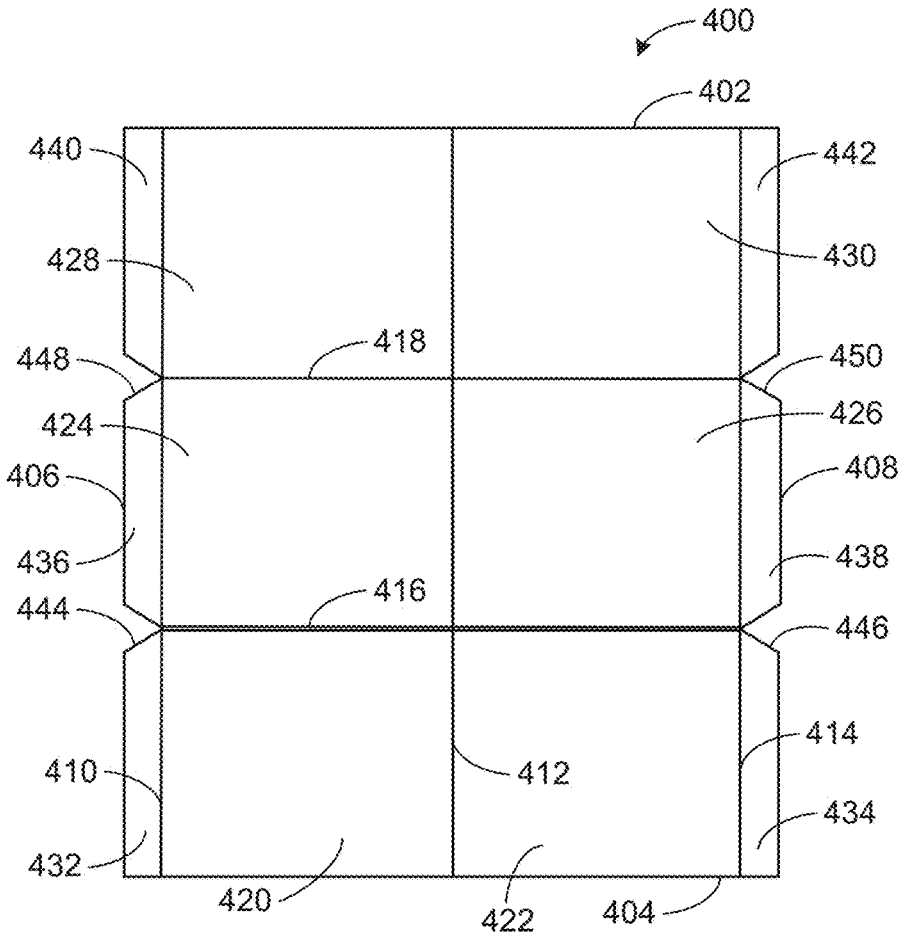
FIG. 4 illustrates a plan view of an example shroud in a flat state that can be used to implement the example self-erectable display of FIG. 1.

FIG. 4 illustrates an example shroud 400 in a flat state that can be used to implement the example self-erectable display 100 of FIG. 1. While the example shroud 400 is shown as being a single piece of substrate, in other examples, the shroud may be more than one piece of substrate that are coupled together to form the example self-erectable display as disclosed herein. In this example, the shroud 400 includes a top edge 402, a bottom edge 404, a first side edge 406 and a second side edge 408. To enable the shroud 400 to be foldable for shipping and/or storage, the shroud 400 defines a first longitudinal line of weakness 410, a second longitudinal line of weakness 412, a third longitudinal line of weakness 414, a first transverse line of weakness 416 and a second transverse line of weakness 418. In this example, the longitudinal lines of weakness 410, 412, 414 are substantially perpendicular relative to the transverse lines of weakness 416, 418. As used herein, substantially perpendicular means between zero to about five degrees from perpendicular and/or accounts for manufacturing tolerances. While the shroud 400 includes the lines of weakness 410, 412, 414, 416, 418, the shroud 400 may include a different number of lines of weakness to define more or less panels and/or portions.

In this example, the longitudinal lines of weakness 410, 412, 414 and the transverse lines of weakness 416, 418 collectively define a first central panel 420, a second central panel 422, a third central panel 424, a fourth central panel 426, a fifth central panel 428, a sixth central panel 430, a first flap 432, a second flap 434, a third flap 436, a fourth flap 438, a fifth flap 440 and a sixth flap 442. As shown in the example of FIG. 4, notches 444, 446, 448, 450 are defined by the shroud 400 between the flaps 432, 434, 436, 438, 440, 442.

To form the tubular-shaped shroud 400, the shroud 400 is folded about the second line of weakness 412 and the flaps 432, 434, 436, 438, 440, 442 are inwardly folded about the first line of weakness 410 and the third line of weakness 414 to enable the opposing flaps (i.e., first flap 432 and second flap 434, third flap 436 and fourth flap 438, and fifth flap 440 and sixth flap 442) to be coupled to one another and disposed within an interior of the shroud 400. The flaps including the opposing flap pairs may be coupled in any suitable way using, for example, adhesive, glue, tape, staples, elastic bands and/or any suitable mechanical and/or chemical fastener(s). After the opposing flap pairs are formed, the shroud 400 may be folded (e.g., a z-fold or a c-fold) about the axes formed by the transverse lines of weakness 416, 418 for shipping and/or storage. In some examples, the notches 444, 446, 448, 450 may more easily enable the shroud 400 to be folded about the transverse lines of weakness 416, 418.

Figure 5:
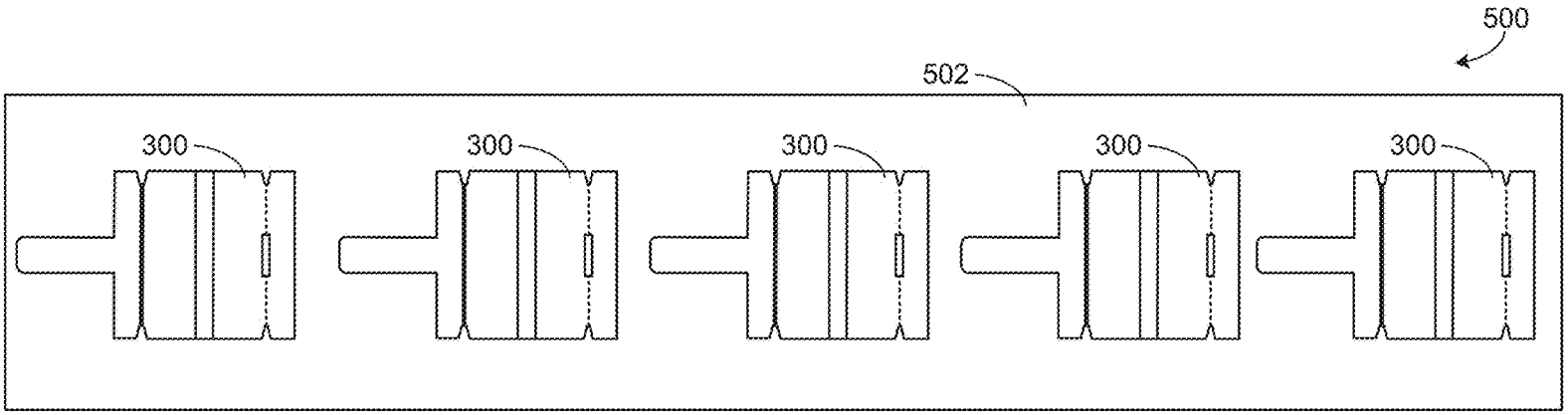
FIG. 5 illustrates a plan view of an example web including a plurality of example support portions that can be used to implement the examples disclosed herein.

FIG. 5 illustrates an example web 500 including the support portions 300 that can be used to implement the examples disclosed herein. In practice, in some examples, each of the support portions 300 may be die cut from a waste matrix 502 surrounding the support portions 300 prior to forming the tubular support.

Figure 6:
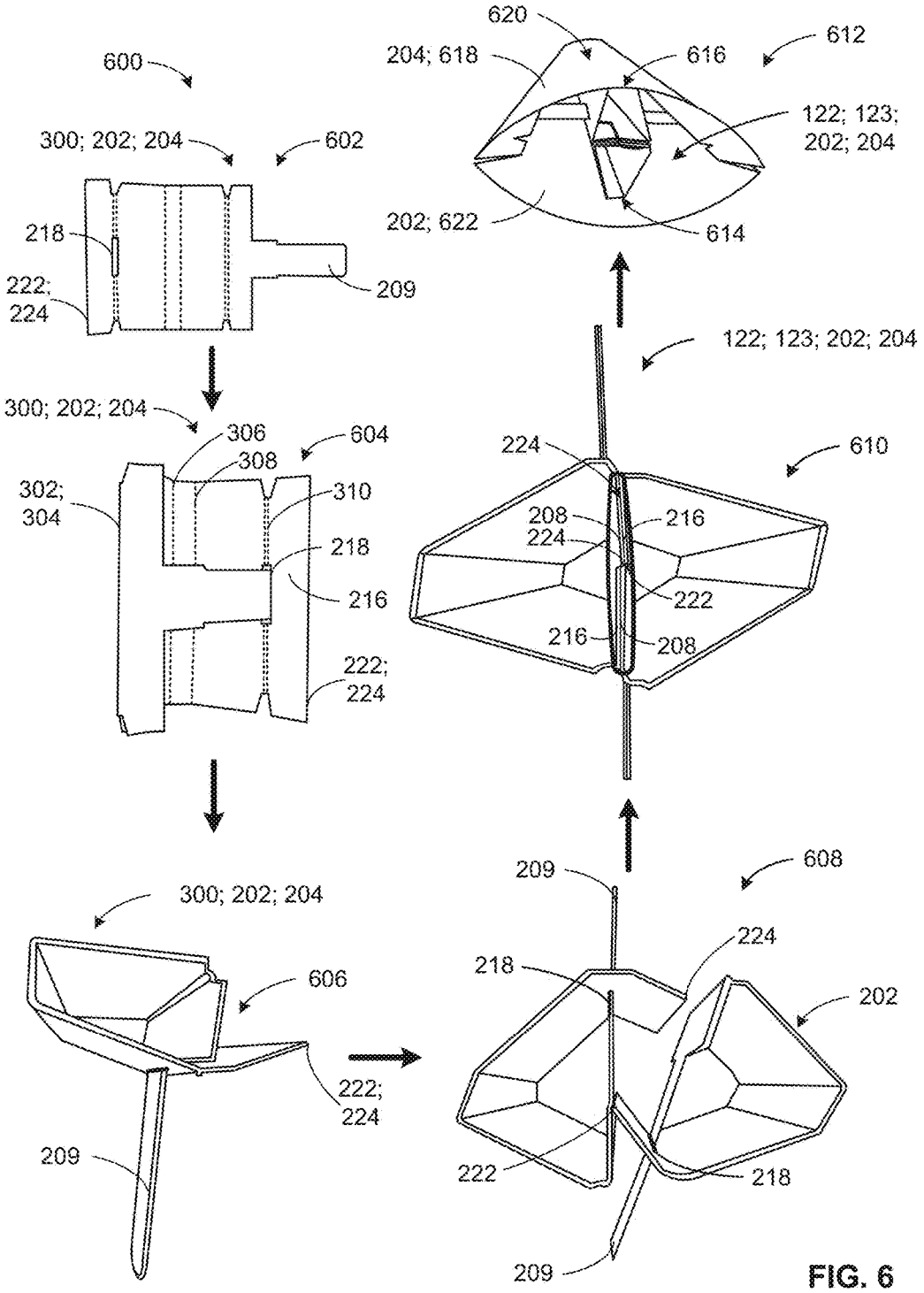
FIG. 6 illustrates an example flow diagram including processes of forming an example support that can used to implement the example self-erectable display of FIG. 1.

FIG. 6 is an example flow diagram 600 that illustrates example processes of assembling the example supports 122, 123 including the example support portions 202, 204 as disclosed herein. Reference number 602 illustrates one example support portion 202, 204 in a flat or non-tubular state. At reference number 604, the support portion 202, 204 is being folded about the lines of weakness 302, 304, 306, 308, 310 and the tongue 209 is being positioned through the aperture 218.

At reference number 606, the tongue 209 is illustrated fully extending through the aperture 218. At reference number 608, two support portions 202, 204 are illustrated opposing one another to enable the tongues 209 of the respective support portions 202, 204 to face in opposite directions. At block 310, to couple the opposing support portions 202, 204 together, the first support panel 208 of the first support portion 202 is coupled to the fifth support panel 216 of the second support portion 204 and/or the first support panel 208 of the second support portion 204 is coupled to the fifth support panel 216 of the first support portion 202. In some examples, the tongue 209 interacts with the fifth support panel 216 and/or the aperture 218. For example, the tongue 209 of the first support portion 202 interacts with an inward facing surface of the fifth panel 216 of the first support portion 202 and/or the aperture 218 of the first support portion 202.

To urge the tongues 209 through the apertures 218 and to urge the stops 222, 224 to be drawn toward one another to position the supports 122, 123 in a stable position, reference number 610 illustrates the elastic band 220 being disposed about the support portions 300, 202, 204 and within two or more of the notches 312, 313, 314, 315. At reference number 612, in some examples, a first fastener 614 and a second fastener 616 (e.g., double sided tape) are coupled to the outwardly facing surfaces of the third panel portion 212 to couple the support 122, 123 to a first intermediate panel 618 of an example display 620 and a second intermediate panel 622 of the example display 620, for example.

Figure 7:
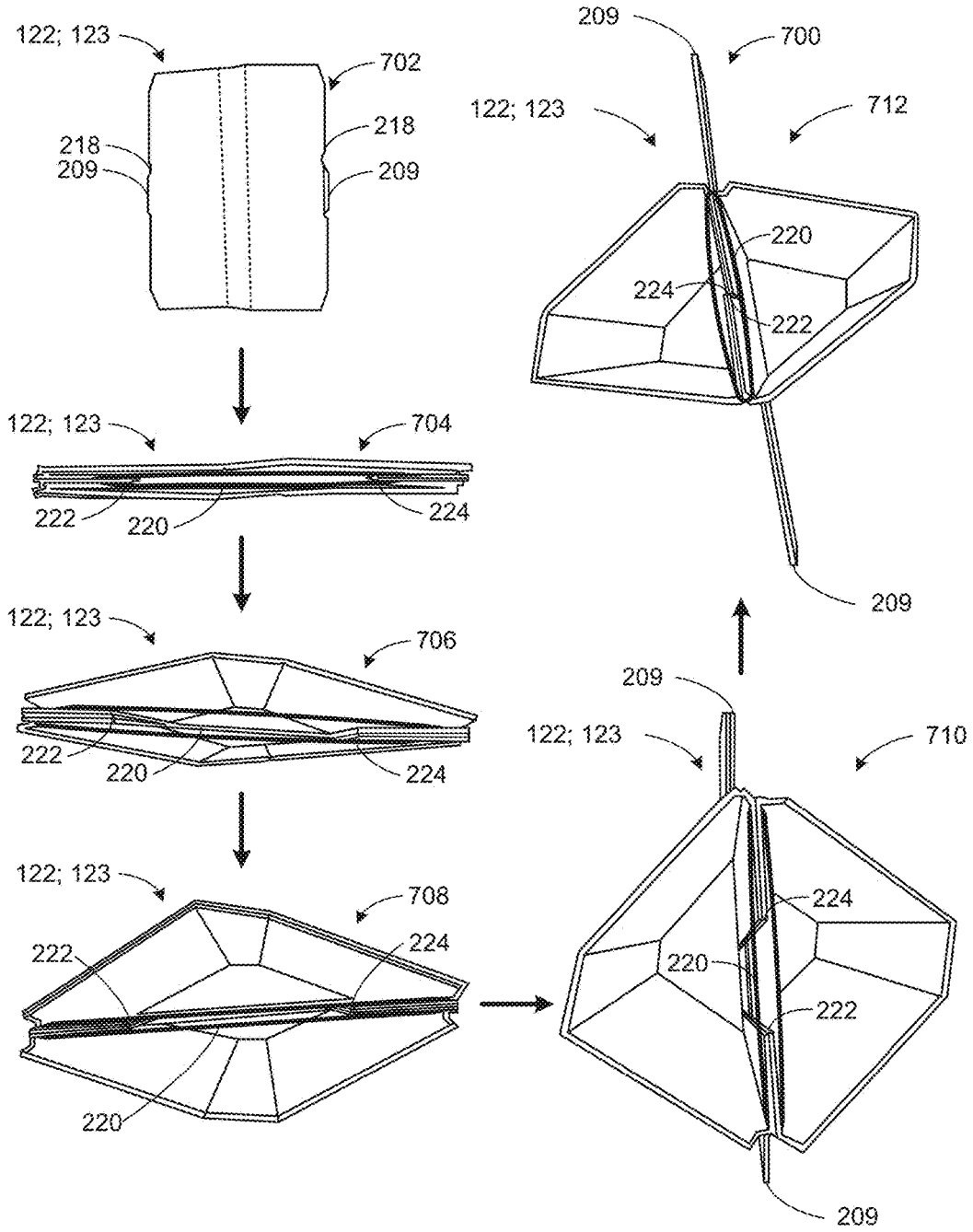
FIG. 7 illustrates an example flow diagram including example processes of transitioning an example support from a flatted state to an erected state.

FIG. 7 is an example flow diagram 700 that illustrates example processes of assembling, erecting and/or expanding the example supports 122, 123 disclosed herein. At reference number 702, a side view of the example support 122, 123 is illustrated in the flattened position with the tongues 209 protruding through the apertures 218. At reference number 704, a top view of the support 122, 123 is illustrated in the flattened position with the stops 222, 224 spaced apart. At reference numbers 706, 708, 710 and 712, the stops 222, 224 are shown being drawn toward one another, via the elastic band 220, and the tongues 209 being urged through the respective apertures as the example support 122, 123 is released and expands.

Figure 8:
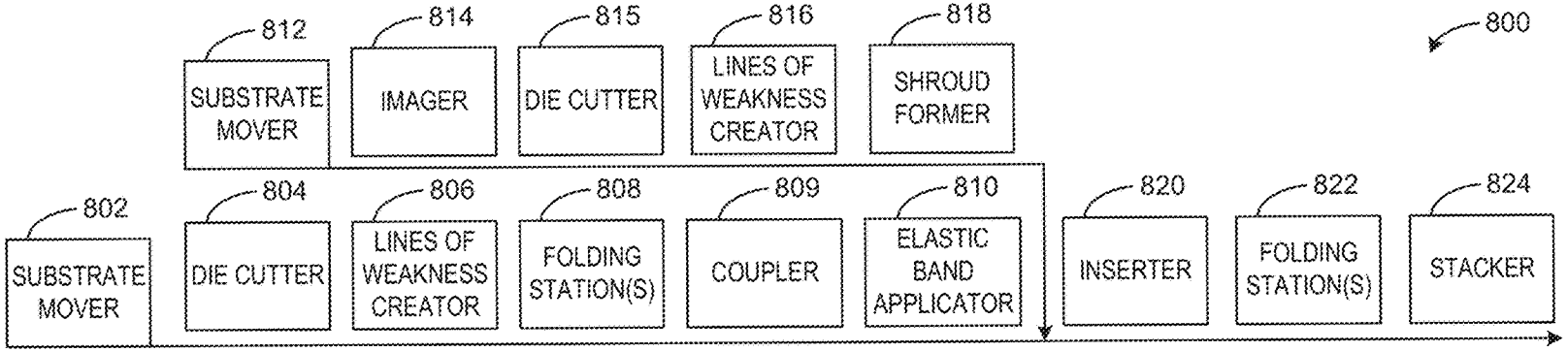
FIG. 8 illustrates an example apparatus that can be used to produce the example self-erectable displays disclosed herein.

FIG. 8 represents an example apparatus 800 that can be used to produce the example self-erectable displays disclosed herein. In some examples, the apparatus 800 performs an in-line process that includes processes to produce an example support and/or example support portions in accordance with the teachings of this disclosure, processes to produce an example shroud in accordance with the teachings of this disclosure and processes to produce an example self-erectable display in accordance with the teachings of this disclosure. While the processes disclosed below are described in connection with automatic processes, any and/or all of the processes disclosed may instead be implemented manually.

In this example, the example apparatus 800 includes elements to produce the example support and/or support portions including, for example, a substrate mover 802, a die cutter 804, a lines of weakness creator 806, a folding station 808, a coupler 809 and an elastic band applicator 810. In this example, the example apparatus 800 also includes elements to produce the example shroud including, for example, a substrate mover 812, an imager 814, a die cutter 815, a lines of weakness creator 816 and a shroud former 818. In this example, the apparatus 800 also includes elements to produce the example self-erectable display including, for example, an inserter 820, a folding station 822 and a stacker 824.

To produce an example support in accordance with the teachings of this disclosure, in some examples, the substrate mover 802 feeds one or more pieces of substrate and/or a web of substrate into the apparatus 800. The die cutter 804 die cuts the substrate to form a support portion blank and a waste matrix and the lines of weakness creator 806 forms one or more lines of weakness on first and/or second sides of the support portion blank using a die(s), a cutting tool(s), a scoring tool(s), a slotting tool(s), etc. The folding station 808 folds the support portion blank along one or more of the lines of weakness to form a support portion. The coupler 809 couples the support portion together by, for example, inserting the tongue on an end of the support portion through an aperture adjacent an opposing end of the support portion. In some examples, the coupler 809 couples two support portions to form a tubular support having tongues extending in opposing directions. In some examples, the coupler 809 applies a fastener such as, for example, an adhesive, glue and/or tape to one or more of the smaller support panels to enable the tubular support to be coupled within the tubular shroud and/or to enable two support portions to be coupled together. The elastic band applicator 810 positions an elastic band about the support within notches (e.g., v-shaped notches, key-shaped notches, etc.) defined by the support and/or the support portions. In some examples, the processes implemented by the folding station 808, the coupler 809 and/or the elastic band applicator 810 are performed manually.

To produce an example shroud in accordance with the teachings of this disclosure, in some examples, the substrate mover 812 feeds one or more pieces of substrate and/or a web of substrate into the apparatus 800. In some examples, the imager 814 images a first and/or a second side of the shroud blank. The images may include brand-related images and/or text, advertising-related images and/or text, point-of-purchase-related images and/or text, instructional images and/or text and/or any other desired indicia. The die cutter 815 die cuts the substrate to form a shroud blank and a waste matrix and the lines of weakness creator 816 forms one or more lines of weakness on first and/or second sides of the shroud blank using a die(s), a cutting tool(s), a scoring tool(s), a slotting tool(s), etc. In some examples, the shroud former 818 forms a tubular-shaped shroud by folding the shroud about a central line of weakness and coupling inwardly facing flaps. In some examples, the processes implemented by the shroud former 818 is performed manually.

To produce an example self-erectable display in accordance with the teachings of this disclosure, in some examples, the inserter 820 inserts and couples one or more example tubular supports within the example shroud. In some examples, the inserter 820 uses adhesive and/or glue to couple the tubular supports within the example shroud. The folding station 822 flattens and/or folds the self-erectable display about longitudinal axes of the shroud and/or folds the self-erectable display about transverse axes of the shroud for storage and/or shipping. The stacker 824 stacks the self-erectable displays for storage and/or shipping, etc. In some examples, the processes implemented by the inserter 820, the folding station 822 and/or the stacker 824 are performed manually.

While the stations and/or portions including the example substrate mover 802, the example die cutter 804, the example lines of weakness creator 806, the example folding station 808, the example coupler 809, the example elastic band applicator 810, the example substrate mover 812, the example imager 814, the die cutter 815, the example lines of weakness creator 816, the example shroud former 818, the example inserter 820, the example folding station 822, the example stacker 824 of the apparatus 800 are depicted in a particular order, the stations and/or portions including the example substrate mover 802, the example die cutter 804, the example lines of weakness creator 806, the example folding station 808, the example coupler 809, the example elastic band applicator 810, the example substrate mover 812, the example imager 814, the die cutter 815, the example lines of weakness creator 816, the example shroud former 818, the example inserter 820, the example folding station 822 and/or the example stacker 824 may be implemented in any other way. For example, the order of the stations and/or portions including the example substrate mover 802, the example die cutter 804, the example lines of weakness creator 806, the example folding station 808, the example coupler 809, the example elastic band applicator 810, the example substrate mover 812, the example imager 814, the die cutter 815, the example lines of weakness creator 816, the example shroud former 818, the example inserter 820, the example folding station 822 and/or the example stacker 824 may be changed, and/or some of the stations and/or portions including the example substrate mover 802, the example die cutter 804, the example lines of weakness creator 806, the example folding station 808, the example coupler 809, the example elastic band applicator 810, the example substrate mover 812, the example imager 814, the die cutter 815, the example lines of weakness creator 816, the example shroud former 818, the example inserter 820, the example folding station 822 and/or the example stacker 824 may be changed, eliminated, or combined. For example, while the apparatus 800 is depicted as having a die cutter being separate from a lines of weakness creator, in some examples, the die cutter and the lines of weakness creator may be combined.

Figure 9:
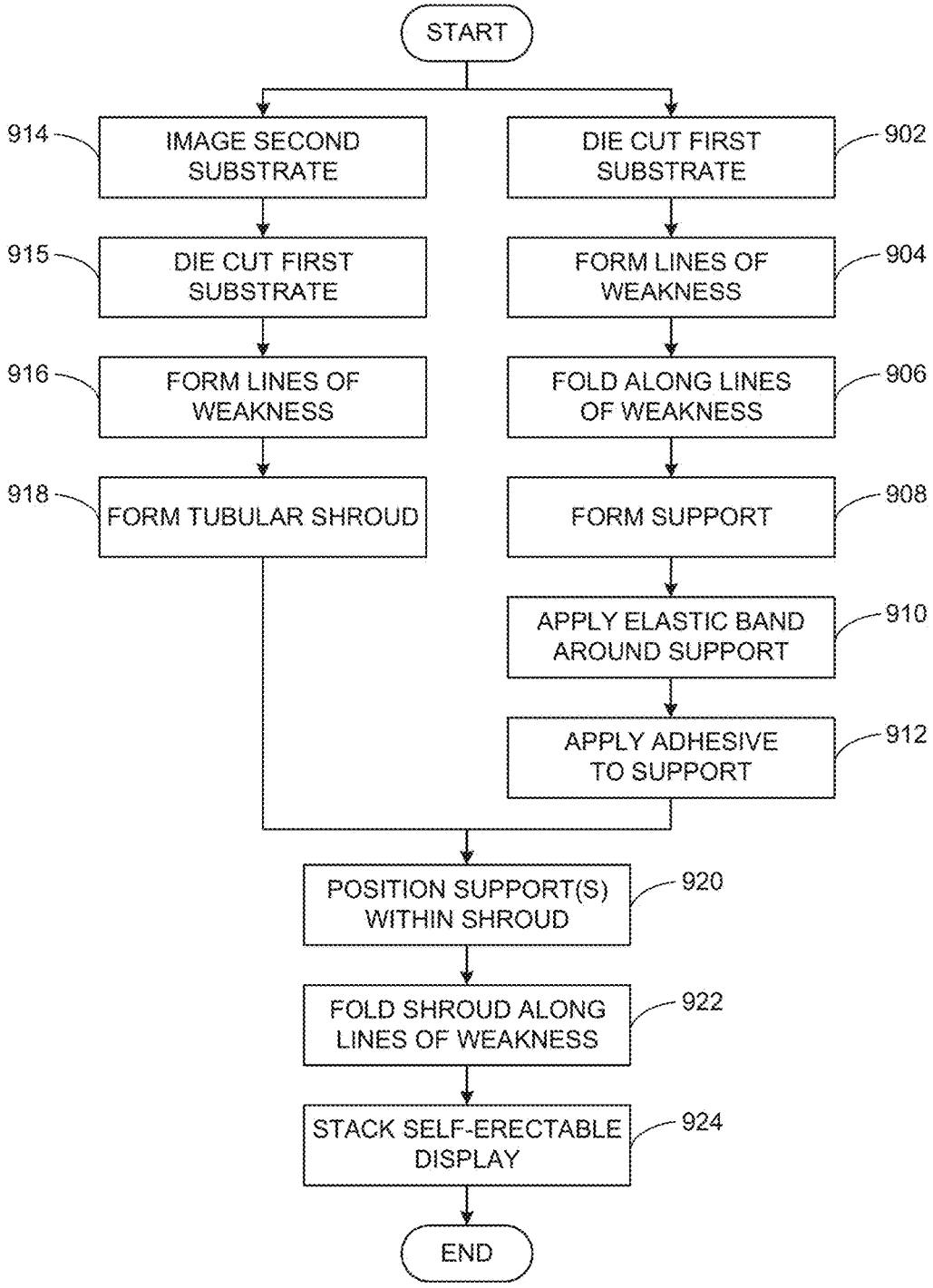
FIG. 9 illustrates a flowchart representative of machine readable instructions that may be executed to implement the apparatus of FIG. 8.

A flowchart representative of example machine readable instructions for implementing the apparatus 800 of FIG. 8 is shown in FIG. 9. In this example, the machine readable instructions comprise a program for execution by a processor such as the processor 1012 shown in the example processor platform 1000 discussed below in connection with FIG. 10. The program may be embodied in software stored on a tangible computer readable storage medium such as a CD-ROM, a floppy disk, a hard drive, a digital versatile disk (DVD), a Blu-ray disk, or a memory associated with the processor 1012, but the entire program and/or parts thereof could alternatively be executed by a device other than the processor 1012 and/or embodied in firmware or dedicated hardware. Further, although the example program is described with reference to the flowchart illustrated in FIG. 9, many other methods of implementing the example apparatus 800 may alternatively be used. For example, the order of execution of the blocks may be changed, and/or some of the blocks described may be changed, eliminated, or combined.

As mentioned above, the example processes of FIG. 9 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering and/or for caching of the information). As used herein, the term tangible computer readable storage medium is expressly defined to include any type of computer readable storage device and/or storage disk and to exclude propagating signals and transmission media. As used herein, "tangible computer readable storage medium" and "tangible machine readable storage medium" are used interchangeably. Additionally or alternatively, the example processes of FIG. 9 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and transmission media. As used herein, when the phrase "at least" is used as the transition term in a preamble of a claim, it is open-ended in the same manner as the term "comprising" is open ended.

The instructions of FIG. 9 directed toward producing an example support includes die cutting a first substrate (e.g., the support portion 300) (block 902) using, for example, the die cutter 804 that die cuts one or more pieces of substrate and/or a web of substrate to form a support portion blank and a waste matrix. Lines of weakness are formed on the support portion blank (block 904) by, for example, the lines of weakness creator 806 forming one or more lines of weakness on first and/or second sides of the support portion blank using a die(s), a cutting tool(s), a scoring tool(s), a slotting tool(s), etc. The support portion blank is folded about the lines of weakness (block 906) using, for example, the folding station 808 that folds the support portion blank along the lines of weakness to form a tubular support. The support is formed (block 908) using, for example, the coupler 809 that couples respective support portions together by inserting one or more tongues of the respective ones of the support portions through an aperture and coupling opposing support portions together. Elastic band(s) and/or other suitable biasing member(s) are applied around the support (block 910) using, for example, the elastic band applicator 810 that positions the elastic band about the support such that the elastic band extends between top and/or bottom edges of the support and across an inner structure and/or support panels disposed on an interior of the support including the two support portions. Fastener(s) such as, for example, an adhesive (e.g., double sided tape) is applied to an exterior surface(s) of the support (block 912) using, for example, the coupler 809 that applies adhesive to one or more of the smaller support panels.

The instructions of FIG. 9 directed toward producing an example shroud includes imaging a second substrate (e.g., the shroud 400) (block 914) using, for example, the imager 814 that images a first and/or second side of the shroud with, for example, brand-related images and/or text, advertising-related images and/or text, point-of-purchase-related images and/or text, instructional images and/or other text, indicia and/or images. The example shroud is die cut (block 915) using, for example, the die cutter 815 that forms one or notches within the shroud, cuts the shroud from a waste matrix and/or cuts the shroud from a web including other shrouds, etc. Lines of weakness are formed on the shroud blank (block 916) using, for example, the lines of weakness creator 816 that forms one or more lines of weakness on first and/or second sides of the shroud blank using a die(s), a cutting tool(s), a scoring tool(s), a slotting tool(s), etc. The tubular shroud is formed (block 918) using, for example, the shroud former 818 that folds the shroud about a central line of weakness and couples inwardly facing flaps using, for example, adhesive, glue and/or a staple(s).

The instructions of FIG. 9 directed toward producing an example self-erectable display in accordance with the teachings of this disclosure also includes inserting a support(s) within the shroud (block 920) using, for example, the inserter 820 that inserts and couples the support(s) within the shroud such that outwardly biased support panels expand the opposing shroud panels to enable the shroud to have an oblong cross-section when erected. The self-erectable display is folded along lines of weakness (block 922) using, for example, the folding station 822 that flattens and/or folds the self-erectable display about longitudinal axes of the shroud and/or transverse axes of the shroud for storage and/or shipping. The folded self-erectable display is stacked (block 924) using, for example, the stacker 824 that stacks the self-erectable displays for storage and/or shipping, etc.

Figure 10:
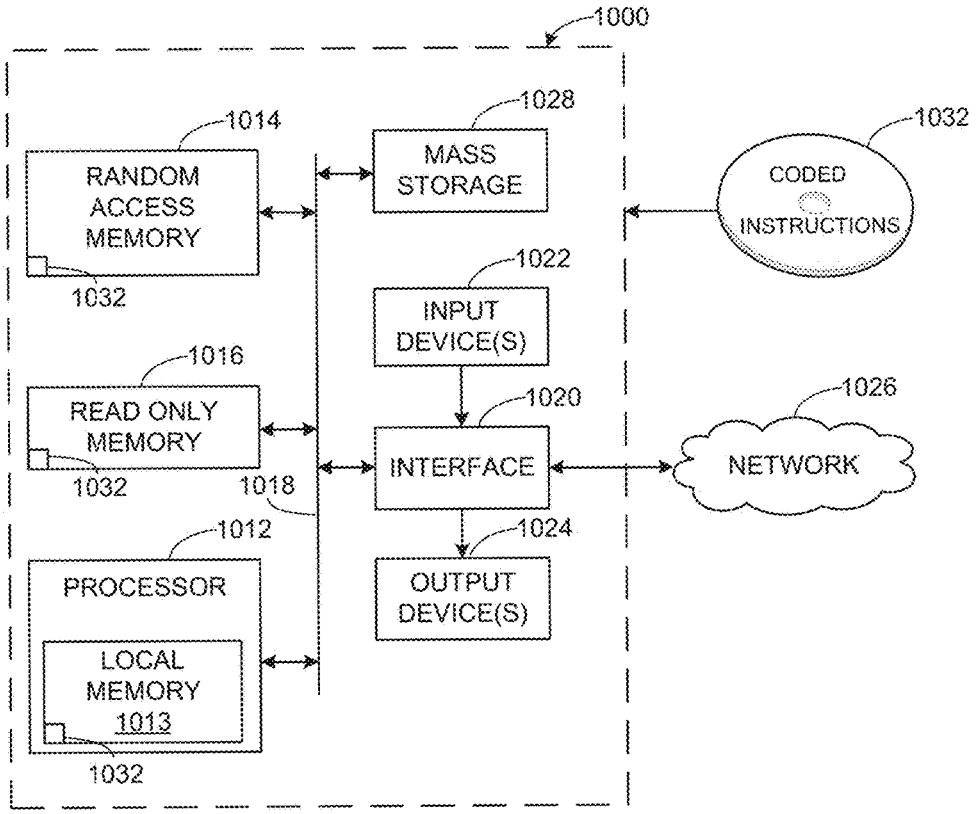
FIG. 10 illustrates a processor platform to execute the instructions of FIG. 9 to implement the apparatus of FIG. 8.

FIG. 10 is a block diagram of an example processor platform 1000 capable of executing the instructions of FIG. 9 to implement the apparatus 800 of FIG. 8. The processor platform 900 can be, for example, a server, a personal computer, a mobile device, or any other type of computing device.

The processor platform 1000 of the illustrated example includes a processor 1012. The processor 1012 of the illustrated example is hardware. For example, the processor 1012 can be implemented by one or more integrated circuits, logic circuits, microprocessors or controllers from any desired family or manufacturer.

The processor 1012 of the illustrated example includes a local memory 1013 (e.g., a cache). The processor 1012 of the illustrated example is in communication with a main memory including a volatile memory 1014 and a non-volatile memory 1016 via a bus 1018. The volatile memory 1014 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1016 may be implemented by flash memory and/or any other desired type of memory device. Access to the main memory 1014, 1016 is controlled by a memory controller.

The processor platform 1000 of the illustrated example also includes an interface circuit 1020. The interface circuit 1020 may be implemented by any type of interface standard, such as an Ethernet interface, a universal serial bus (USB), and/or a PCI express interface.

In the illustrated example, one or more input devices 1022 are connected to the interface circuit 1020. The input device(s) 1022 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1024 are also connected to the interface circuit 1020 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1020 of the illustrated example, thus, typically includes a graphics driver card, a graphics driver chip or a graphics driver processor.

The interface circuit 1020 of the illustrated example also includes a communication device such as a transmitter, a receiver, a transceiver, a modem and/or network interface card to facilitate exchange of data with external machines (e.g., computing devices of any kind) via a network 1026 (e.g., an Ethernet connection, a digital subscriber line (DSL), a telephone line, coaxial cable, a cellular telephone system, etc.).

The processor platform 1000 of the illustrated example also includes one or more mass storage devices 1028 for storing software and/or data. Examples of such mass storage devices 1028 include floppy disk drives, hard drive disks, compact disk drives, Blu-ray disk drives, RAID systems, and digital versatile disk (DVD) drives.

The coded instructions 1032 of FIG. 10 may be stored in the mass storage device 1028, in the volatile memory 1014, in the non-volatile memory 1016, and/or on a removable tangible computer readable storage medium such as a CD or DVD.

The examples self-erectable displayed disclosed herein may be deployed from a storage state to an erected or deployed state with little effort. For example, a user such as, for example, a shop clerk, can remove a folded display from an outer packaging or container and unfold the display along the lines of weakness disclosed above. The force imparted by the biasing member(s) on the internal supports, automatically forces the outer shroud panels to expand away from one of other as disclosed above. In other words, as the display is unfolded, the display simply pops open by itself. The deployment of the display is then complete and the display is ready for placement in a desired location and/or coupling to an optional base should additional stability be desired.

An example apparatus includes a shroud including a first shroud panel opposite a second shroud panel; a support coupled within the shroud, the support including: a first support portion including a first top edge, a first bottom edge, and first and second side edges, the first side edge extending through a first aperture defined by the first support; and a second support portion including a second top edge, a second bottom edge, and third and fourth side edges, the third side edge extending through a second aperture defined by the second support, the first support to be coupled to the second support, the first side edge to extend in a first direction and the third side edge to extend in a second direction, the first and second support portions to outwardly bias the first shroud panel from the second shroud panel.

In some examples, the apparatus includes an elastic band positioned around the support to draw the support together. In some examples, the first support includes a first stop and the second support includes a second stop, the first stop to engage the second stop to restrict further movement of the support. In some examples, the first and second stops are to be disposed within a first plane. In some examples, the first side edge includes a first tongue is to be disposed within a second plane, the second edge including a second tongue is to be disposed within a third plane. In some examples, the second plane is different than the third plane. In some examples, the first side edge is to be guided into the first aperture via a support panel of the first support portion. In some examples, the first support portion includes a first support panel and the second support portion includes a second support panel, the first side edge including a first tongue is to be coupled to the second support panel and the second side edge including a second tongue is to be coupled to the first support panel. In some examples, the first support portion includes a first support panel and the second support portion includes a second support panel, the first support panel to be coupled to the first shroud panel and the second support panel to be coupled to the second shroud panel.

In some examples, the shroud includes a first shroud line of weakness and a second shroud line of weakness, the first shroud line of weakness separating the first shroud panel, the second shroud panel at a first end of the shroud, the second shroud line of weakness separating the first shroud panel and the second shroud panel at a second end of the shroud. In some examples, the shroud is collapsible to a storage state by urging the first shroud panel toward the second shroud panel against a biasing force of the support. In some examples, the apparatus is a self-erecting display. In some examples, the first direction opposite the second direction.

An example apparatus includes a first support portion including a top edge, a bottom edge, and first and second side edges, the first side edge to extend through an aperture defined by the first support; and a second support portion, the first support portion to be coupled to the second support portion to form a support to be coupled within a self-erectable display. In some examples, the first support portion includes a first stop and the second support portion includes a second stop, the first stop is to engage the second stop to restrict further movement of the support. In some examples, the first and second stops are to be disposed within a first plane. In some examples, the first support portion includes a first support panel and the second support portion includes a second support panel, the first side edge including a first tongue is to be coupled to the second support panel and a third side edge of the second support portion including a second tongue is to be coupled to the first support panel. In some examples, the first support panel includes a first stop and the second support panel includes a second stop, the first stop to engage the second stop to restrict further movement of the support.

An example apparatus includes a shroud including a first shroud panel, a second shroud panel coupled to the first shroud panel, and an interior formed between the first shroud panel and the second shroud panel; a support disposed in the interior of the shroud, the support including a first tongue and a second tongue, the first tongue to extend through a first aperture of the support, the second tongue to extend through a second aperture of the support, the first and second tongues to extend in opposing directions; and a biasing member coupled to the support to cause a portion of the first shroud panel to separate from a portion of the second shroud panel. In some examples, the interior has an oblong cross-section.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a shroud including a first shroud panel opposite a second shroud panel;

a support coupled within the shroud, the support including:

a first support portion formed of a first substrate, the first support portion including a first top edge, a first bottom edge, and first and second side edges, the first side edge extending through a first aperture defined by the first support portion; and a second support portion formed of a second substrate, the second support portion including a second top edge, a second bottom edge, and third and fourth side edges, the third side edge extending through a second aperture defined by the second support portion, the first support portion to be coupled to the second support portion, the first side edge to extend in a first direction and the third side edge to extend in a second direction, the first and second support portions to outwardly bias the first shroud panel from the second shroud panel.

2. The apparatus of claim 1, further including an elastic band positioned around the support to draw the support together.

3. The apparatus of claim 1, wherein the first support portion includes a first stop and the second support portion includes a second stop, the first stop to engage the second stop to restrict further movement of the support.

4. The apparatus of claim 3, wherein the first and second stops are to be disposed within a first plane.

5. The apparatus of claim 4, wherein the first side edge including a first tongue is to be disposed within a second plane, the second edge including a second tongue is to be disposed within a third plane.

6. The apparatus of claim 5, wherein the second plane is different than the third plane.

7. The apparatus of claim 3, wherein the first side edge is to be guided into the first aperture via a support panel of the first support portion.

8. The apparatus of claim 3, wherein the first support portion includes a first support panel and the second support portion includes a second support panel, the first side edge including a first tongue is to be coupled to the second support panel and the second side edge including a second tongue is to be coupled to the first support panel.

9. The apparatus of claim 1, wherein the first support portion includes a first support panel and the second support portion includes a second support panel, the first support panel to be coupled to the first shroud panel and the second support panel to be coupled to the second shroud panel.

10. The apparatus of claim 1, wherein the shroud includes a first shroud line of weakness and a second shroud line of weakness, the first shroud line of weakness separating the first shroud panel and the second shroud panel at a first end of the shroud, the second shroud line of weakness separating the first shroud panel and the second shroud panel at a second end of the shroud.

11. The apparatus of claim 10, wherein the shroud is collapsible to a storage state by urging the first shroud panel toward the second shroud panel against a biasing force of the support.

12. The apparatus of claim 1, wherein the apparatus is a self-erecting display.

13. The apparatus of claim 1, wherein the first direction is opposite the second direction.

14. An apparatus, comprising:

a shroud including a first shroud panel, a second shroud panel coupled to the first shroud panel, and an interior formed between the first shroud panel and the second shroud panel;

a support disposed in the interior of the shroud, the support including a first tongue and a second tongue, the first and second tongues being formed of separate substrates, the first tongue to extend through a first aperture of the support, the second tongue to extend through a second aperture of the support, the first and second tongues to extend in opposing directions; and a biasing member coupled to the support to cause a portion of the first shroud panel to separate from a portion of the second shroud panel.

15. The apparatus of claim 14, wherein the interior has an oblong cross-section.

16. An apparatus of claim 1, comprising:

a shroud including a first shroud panel opposite a second shroud panel;

a support coupled within the shroud, the support including:

a first support portion including a first top edge, a first bottom edge, and first and second side edges, the first side edge extending through a first aperture defined by the first support portion, wherein the first support portion includes a first panel, a second panel, a third panel, a fourth panel, and a fifth panel, a first line of weakness separating the first panel and the second panel, a second line of weakness separating the second panel and the third panel, a third line of weakness separating the third panel and the fourth panel, and a fourth line of weakness separating the fourth panel and the fifth panel, the first aperture defined along the first line of weakness, first panel including the second side edge, the fifth panel including the first side edge; and a second support portion including a second top edge, a second bottom edge, and third and fourth side edges, the third side edge extending through a second aperture defined by the second support portion, the first support portion to be coupled to the second support portion, the first side edge to extend in a first direction and the third side edge to extend in a second direction, the first and second support portions to outwardly bias the first shroud panel from the second shroud panel.

17. The apparatus of claim 16, wherein the second support portion includes a sixth panel, a seventh panel, an eighth panel, a ninth panel, and a tenth panel, a fifth line of weakness separating the sixth panel and the seventh panel, a sixth line of weakness separating the seventh panel and the eighth panel, a seventh line of weakness separating the eighth panel and the ninth panel, and an eighth line of weakness separating the ninth panel and the tenth panel, the second aperture defined along the fifth line of weakness, the sixth panel including the fourth side edge, the tenth panel including the third side edge.

18. The apparatus of claim 17, wherein when the first support portion is coupled to the second support portion, the first panel is coupled adjacent the tenth panel and the fifth panel is coupled adjacent the sixth panel.

19. The apparatus of claim 18, wherein when the first support portion is coupled to the second support portion and an elastic band draws the support together, the second side edge engages the fourth side edge.

20. The apparatus of claim 19, wherein the second side edge is guided into engagement with the fourth side edge based on the first panel interacting with the fifth panel and the tenth panel, the fourth side edge is guided into engagement with the second side edge based on the sixth panel interacting with the fifth panel and the tenth panel.

* * * * *